US009695841B2

(12) United States Patent
Udagawa et al.

(10) Patent No.: US 9,695,841 B2
(45) Date of Patent: Jul. 4, 2017

(54) HYDRAULIC CLOSED CIRCUIT SYSTEM

(71) Applicant: HITACHI CONSTRUCTION MACHINERY CO., LTD., Tokyo (JP)

(72) Inventors: Tsutomu Udagawa, Tsukuba (JP); Hiroaki Tanaka, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 298 days.

(21) Appl. No.: 14/398,476

(22) PCT Filed: Mar. 29, 2013

(86) PCT No.: PCT/JP2013/059687
§ 371 (c)(1),
(2) Date: Nov. 3, 2014

(87) PCT Pub. No.: WO2013/175866
PCT Pub. Date: Nov. 28, 2013

(65) Prior Publication Data

US 2015/0107236 A1 Apr. 23, 2015

(30) Foreign Application Priority Data

May 24, 2012 (JP) ..... 2012-119044

(51) Int. Cl.
*F15B 9/04* (2006.01)
*E02F 9/20* (2006.01)
(Continued)

(52) U.S. Cl.
CPC ..... *F15B 9/04* (2013.01); *E02F 9/2095* (2013.01); *E02F 9/2217* (2013.01);
(Continued)

(58) Field of Classification Search
CPC ..... E02F 9/2095; E02F 9/2217; E02F 9/2235; E02F 9/2242; E02F 9/289; E02F 9/2292;
(Continued)

(56) References Cited

U.S. PATENT DOCUMENTS 8,720,197 B2 * 5/2014 Persson ..... E02F 9/2217 60/456
2007/0079609 A1 4/2007 Brinkman et al.
2007/0199315 A1 8/2007 Grossart

FOREIGN PATENT DOCUMENTS

JP 63-096303 A 4/1988
JP 2002-054602 A 2/2002
(Continued)

OTHER PUBLICATIONS

Machine Translation of JP 2002-054602 A, Osuga et al. , Sumitomo Construction Machinery Manufacturing CO LTD, Feb. 20, 2002.*
(Continued)

*Primary Examiner* — Logan Kraft
(74) *Attorney, Agent, or Firm* — Mattingly & Malur, PC

(57) ABSTRACT

In a hydraulic closed circuit system with hydraulic pumps which maintains a well-balanced flow rate by automatically controlling the flow rate, a first hydraulic pump is connected to a hydraulic cylinder device such that the hydraulic closed circuit is made, a second hydraulic pump is connected at one of paired delivery ports to a bottom side of the hydraulic cylinder device and at the other of the ports to a tank, and a prime mover drives the first and second hydraulic pumps and recovers motive power from these pumps. A pump capacity control unit detects a moving direction of the hydraulic cylinder device, and a pressure in a lower-thrust side of the device, and controls a capacity of the second hydraulic pump so that the flow rate during the extension/retraction of the hydraulic cylinder device becomes balanced
(Continued)

between the first and second hydraulic pumps and the hydraulic cylinder device.

13 Claims, 9 Drawing Sheets

(51) Int. Cl.
*E02F 9/22* (2006.01)
*F15B 7/00* (2006.01)
*F15B 11/024* (2006.01)

(52) U.S. Cl.
CPC ..... *E02F 9/2235* (2013.01); *E02F 9/2242* (2013.01); *E02F 9/2289* (2013.01); *E02F 9/2292* (2013.01); *E02F 9/2296* (2013.01); *F15B 7/006* (2013.01); *F15B 11/024* (2013.01); *F15B 2211/20515* (2013.01); *F15B 2211/20538* (2013.01); *F15B 2211/20546* (2013.01); *F15B 2211/20561* (2013.01); *F15B 2211/20569* (2013.01); *F15B 2211/20576* (2013.01); *F15B 2211/253* (2013.01); *F15B 2211/265* (2013.01); *F15B 2211/27* (2013.01); *F15B 2211/625* (2013.01); *F15B 2211/6313* (2013.01); *F15B 2211/6336* (2013.01); *F15B 2211/6652* (2013.01); *F15B 2211/7053* (2013.01); *F15B 2211/88* (2013.01)

(58) Field of Classification Search
CPC ..... E02F 9/2296; E02F 9/22962; F15B 7/006; F15B 9/04; F15B 11/024; F15B 11/17; F15B 2211/20515; F15B 2211/20538; F15B 2211/20546; F15B 2211/20561; F15B 2211/20569; F15B 2211/20576; F15B 2211/253; F15B 2211/265; F15B 2211/27; F15B 2211/613; F15B 2211/625; F15B 2211/6313; F15B 2211/636; F15B 2211/6652; F15B 2211/7053; F15B 2211/88; F15B 2211/6336
See application file for complete search history.

(56) References Cited

FOREIGN PATENT DOCUMENTS

| | | | |
|---|---|---|---|
| JP | 2006-194325 | A | 7/2006 |
| JP | 2006-336842 | A | 12/2006 |
| JP | 2009-079775 | A | 4/2009 |
| JP | 4733645 | B2 | 4/2011 |
| WO | 2009/102740 | A2 | 8/2009 |

OTHER PUBLICATIONS

Machine Translation of JP 2006-194325 A, Hoshino, BOsch Rexroch CORP, Jul. 27, 2006.*
International Preliminary Report on Patentability received in International Application No. PCT/JP2013/059687 dated Dec. 4, 2014.
Extended European Search Report received in corresponding European Application No. 13794458.3 dated Apr. 12, 2016.

* cited by examiner

HYDRAULIC CLOSED CIRCUIT SYSTEM

TECHNICAL FIELD

The present invention relates to hydraulic closed circuit systems.

BACKGROUND ART

Conventional hydraulic closed circuit systems with a single rod type of hydraulic cylinder device as a hydraulic actuator, generally include a low pressure selecting valve (flushing valve) and a charge circuit as well, thereby providing a closed circuit.

The related art described in Patent Document 1 (JP, A 2002-54602) eliminates the need for the low pressure selecting valve (flushing valve) in such a conventional hydraulic closed circuit system by incorporating the following measure as an alternative. That is, this alternative includes: arranging two hydraulic pumps of a bidirectional delivery type as a hydraulic source; connecting one of the hydraulic pumps at its paired delivery ports to a bottom-side port and rod-side port of the hydraulic cylinder device, thereby composing a hydraulic closed circuit; and connecting the other hydraulic pump at one of its paired delivery ports to the bottom-side port of the hydraulic cylinder device and at the other of the paired delivery ports to a tank. The alternative absorbs a difference in a flow rate of a hydraulic fluid between the bottom side and rod side of the hydraulic cylinder device.

PRIOR ART DOCUMENTS

Patent Document

Patent Document 1: JP, A 2002-54602

SUMMARY OF THE INVENTION

Problem to be Solved by the Invention

The general hydraulic closed circuit systems in related art have had a problem in that hunting of the low pressure selecting valve (flushing valve) causes difficulty in achieving smooth operation of the hydraulic cylinder device. The hydraulic closed circuit system described in Patent Document 1 absorbs the difference in the flow rate of the hydraulic fluid between the bottom side and rod side of the hydraulic cylinder device by connecting one of the two hydraulic pumps to the bottom-side port of the hydraulic cylinder device, thereby eliminating the need for the low pressure selecting valve (flushing valve). The hydraulic closed circuit system described in Patent Document 1, therefore, poses no problem with respect to the hunting of the low pressure selecting valve (flushing valve) which causes the difficulty in achieving smooth operation of the hydraulic cylinder device.

The hydraulic closed circuit system described in Patent Document 1, however, has the following problem.

The hydraulic closed circuit system of Patent Document 1 sets a delivery rate per revolution (i.e., a pump capacity) for the hydraulic pumps on the basis of a difference in area between the bottom side and rod side of the hydraulic cylinder device. The hydraulic cylinder device, however, is considered to often fail to achieve an ideal flow rate balance during its extension/retraction because of a likely error such as a pump capacity setting error, capacity error due to deterioration over time, or flow rate error due to leakage to an exterior. Failure to achieve the ideal flow rate balance during the extension/retraction of the hydraulic cylinder device causes a surplus or insufficiency of an inflow volume to and outflow volume from the hydraulic cylinder device, hence resulting in trouble such as cavitation due to the insufficiency of the flow rate, or an increase in pressure due to the build-up of pressure caused by the surplus of the flow rate.

The present invention has been made with the above problems in mind, and an object of the invention is to provide a hydraulic closed circuit system employing a plurality of hydraulic pumps, the hydraulic closed circuit system being configured so that even if an imbalance of a flow rate of a hydraulic fluid during extension/retraction of a hydraulic cylinder device is caused by a pump capacity error or the like, the system can always maintain a well-balanced flow rate by automatically controlling the flow rate.

Means for Solving the Problem (1) In order to attain the above object, the present invention includes: a hydraulic cylinder device; a first hydraulic pump of a bidirectional delivery type connected to the hydraulic cylinder device in such a manner that a hydraulic closed circuit is made; a second hydraulic pump of a bidirectional delivery and bidirectional variable displacement type, connected at one of paired delivery ports thereof to a bottom side of the hydraulic cylinder device and at the other of the paired delivery ports to a tank; a prime mover that drives the first and second hydraulic pumps and recovers motive power from the first and second hydraulic pumps; and a pump capacity control unit configured to: detect a direction in which the hydraulic cylinder device operates, detect a pressure applied on a lower-thrust side of the hydraulic cylinder device, and control a capacity of the second hydraulic pump such that a flow rate of a hydraulic fluid during extension/retraction of the hydraulic cylinder device becomes balanced between the first and second hydraulic pumps and the hydraulic cylinder device.

Accordingly, in a hydraulic closed circuit system employing the plurality of hydraulic pumps, even if an imbalance of the flow rate of the hydraulic fluid during the extension/retraction of the hydraulic cylinder device is caused by a pump capacity error or the like, a well-balanced flow rate can always be maintained by automatically controlling the flow rate. This in turn enables effective suppression of cavitation due to an insufficiency of the flow rate and of an increase in pressure due to the build-up of pressure caused by a surplus of the flow rate.

(2) More specifically, the pump capacity control unit of the hydraulic closed circuit system described in item (1) above performs control so that: during extending operation of the hydraulic cylinder device, if the pressure in the lower-thrust side of the hydraulic cylinder device is lower than a reference pressure value, the capacity of the second hydraulic pump is increased, and if the pressure in the lower-thrust side of the hydraulic cylinder device is higher than the reference pressure value, the capacity of the second hydraulic pump is decreased; and wherein the pump capacity control unit performs control so that: during retracting operation of the hydraulic cylinder device, if the pressure in the lower-thrust side of the hydraulic cylinder device is higher than the reference pressure value, the capacity of the second hydraulic pump is increased, and if the pressure in the lower-thrust side of the hydraulic cylinder device is lower than the reference pressure value, the capacity of the second hydraulic pump is decreased.

Accordingly, in a hydraulic closed circuit system employing the plurality of hydraulic pumps, even if an imbalance of the flow rate of the hydraulic fluid during the extension/retraction of the hydraulic cylinder device is caused by a pump capacity error or the like, a well-balanced flow rate can always be maintained by automatically controlling the flow rate. This in turn enables effective suppression of cavitation due to an insufficiency of the flow rate and of an increase in pressure due to the build-up of pressure caused by a surplus of the flow rate.

(3) For example, the pump capacity control unit of the hydraulic closed circuit system described in item (2) above, includes: an operation detecting device that detects the direction in which the hydraulic cylinder device operates; a first and a second pressure detecting device configured to detect respectively a pressure applied to the bottom side of the hydraulic cylinder device, and a pressure applied to a rod side of the hydraulic cylinder device; and a pump capacity correcting device configured to determine, on the basis of values detected by the operation detecting device and the first and second pressure detecting devices, whether the hydraulic cylinder device is in power-running operation or in regenerative operation and whether the hydraulic cylinder device is being extended or retracted, calculate a correction value for the capacity of the second hydraulic pump on the basis of results of the determination, and thereby control the capacity of the second hydraulic pump; the pump capacity correcting device being further configured so that if the reference pressure value is expressed as Pref, the bottom-side pressure of the hydraulic cylinder device as Pb, and the rod-side pressure thereof as Pr, then:

(a) when the hydraulic cylinder device is being extended and is in power-running operation, the correcting device increases the correction value as the rod-side pressure Pr decreases relative to the reference pressure value Pref, and reduces the correction value as the rod-side pressure Pr increases;

(b) when the hydraulic cylinder device is being extended and is in regenerative operation, the correcting device increases the correction value as the bottom-side pressure Pb decreases relative to the reference pressure value Pref, and reduces the correction value as the bottom-side pressure Pb increases;

(c) when the hydraulic cylinder device is being retracted and is in power-running operation, the correcting device reduces the correction value as the bottom-side pressure Pb decreases relative to the reference pressure value Pref, and increases the correction value as the bottom-side pressure Pb increases; and (d) when the hydraulic cylinder device is being retracted and is in regenerative operation, the correcting device reduces the correction value as the rod-side pressure Pr decreases relative to the reference pressure value Pref, and increases the correction value as the rod-side pressure Pr increases.

Accordingly, in a hydraulic closed circuit system employing the plurality of hydraulic pumps, even if an imbalance of the flow rate of the hydraulic fluid during the extension/retraction of the hydraulic cylinder device is caused by a pump capacity error or the like, a well-balanced flow rate can always be maintained by automatically controlling the flow rate. This in turn enables effective suppression of cavitation due to an insufficiency of the flow rate and of an increase in pressure due to the build-up of pressure caused by a surplus of the flow rate.

(4) Alternatively, the pump capacity control unit of the hydraulic closed circuit system described in item (2) above may include: an operation detecting device that detects the direction in which the hydraulic cylinder device operates; a lower-thrust-side pressure selecting valve that selects, from pressures inside a bottom-side hydraulic chamber and a rod-side hydraulic chamber of the hydraulic cylinder device, the pressure inside the hydraulic chamber of the lower-thrust side of the hydraulic cylinder device; a pressure detection device that detects the pressure that the lower-thrust-side pressure selecting valve has selected; and a pump capacity correcting device configured to calculate a correction value for the capacity of the second hydraulic pump on the basis of values detected by the operation detecting device and the pressure detection device, and thereby control the capacity of the second hydraulic pump. In this case, the pump capacity correcting device includes: a reference data setter that sets the reference pressure value; a first calculating device that calculates, from a differential value between the reference pressure value and the pressure value detected by the pressure detection device, a correction value for the capacity of the second hydraulic pump operative when the hydraulic cylinder device is being extended; a second calculating device that calculates, from a differential value between the reference pressure value and the pressure value detected by the pressure detection device, a correction value for the capacity of the second hydraulic pump operative when the hydraulic cylinder device is being retracted; and a selector that selects one of the first and second calculating devices, depending upon the operating direction of the hydraulic cylinder device that the operation detecting device has detected.

With the above system configuration, thrust calculation and the determination of the lower-thrust side by the pump capacity correcting device can be omitted and hence, arithmetic processing by the pump capacity correcting device can be simplified. In addition, the number of pressure detection devices can be reduced, which provides a greater advantage in terms of costs.

(5) In the hydraulic closed circuit system described in item (3) or (4) above, the pump capacity correcting device preferably provides a deadband in which the pump capacity correcting device does not correct the capacity of the second hydraulic pump in a predetermined pressure range including the reference pressure value.

Thus the correction value for the capacity of the second hydraulic pump is calculated only when pressure oversteps the deadband. This means that control can be conducted only when necessary.

(6) The prime mover of the hydraulic closed circuit system described in any one of items (1) to (5) above may be an electric motor or a hydraulic motor.

Accordingly, if the prime mover is an electric motor, the first and second hydraulic pumps rotate the electric motor when the hydraulic cylinder device is in regenerative operation, whereby the motive power regenerated will be recovered as electrical energy. If the prime mover is a hydraulic motor, the first and second hydraulic pumps rotate the hydraulic motor when the hydraulic cylinder device is in regenerative operation, whereby the motive power regenerated will be recovered as hydraulic energy.

(7) In addition, the first and second hydraulic pumps of the hydraulic closed circuit system described in any one of items (1) to (5) above may be replaced by a pump of a single-pump double-port flow distribution type. In this case, the pump capacity control unit controls the capacity of the second hydraulic pump by changing a flow rate ratio of the hydraulic fluid in two ports of the pump of the single-pump double-port flow distribution type.

This makes the system simpler and more compact, hence providing a greater advantage in terms of costs.

Effects of the Invention

In a hydraulic closed circuit system with a plurality of hydraulic pumps that is provided in accordance with the present invention, even if an imbalance of a flow rate of a hydraulic fluid during extension/retraction of a hydraulic cylinder device is caused by a pump capacity error or the like, a well-balanced flow rate can always be maintained by automatically controlling the flow rate. This in turn enables effective suppression of cavitation due to an insufficiency of the flow rate and of an increase in pressure due to the build-up of pressure caused by a surplus of the flow rate.

MODES FOR CARRYING OUT THE INVENTION

Embodiments of the present invention will be described using the accompanying drawings.

First Embodiment

Figure 1:
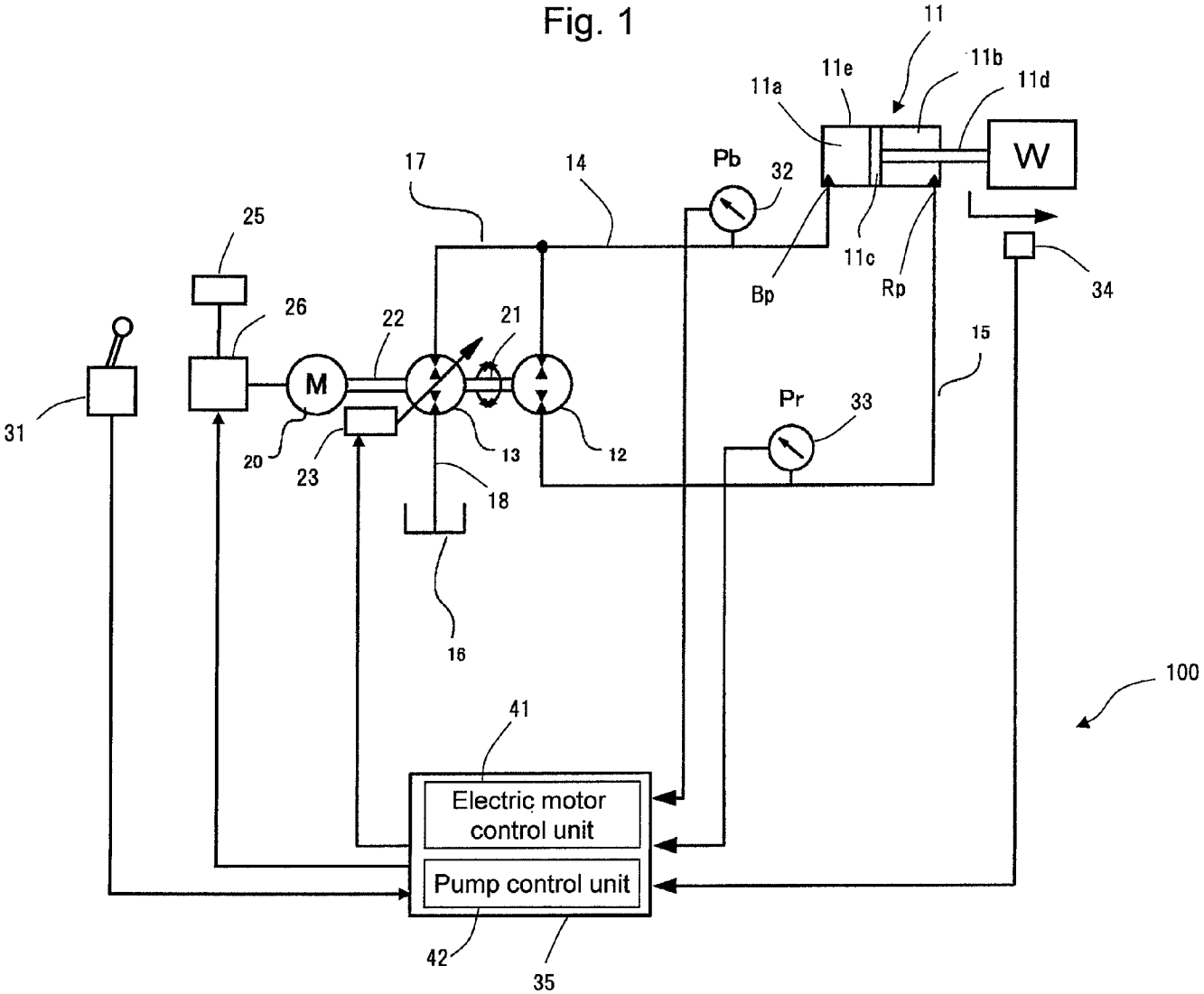
FIG. 1 shows a configuration of a hydraulic closed circuit system according to a first embodiment of the present invention.

FIG. 1 shows a configuration of a hydraulic closed circuit system according to a first embodiment of the present invention.

Reference number 11 in FIG. 1 denotes a hydraulic cylinder device driven by the hydraulic closed circuit system according to the present embodiment. The hydraulic cylinder device 11 is a hydraulic actuator for actuating various movable members of a construction machine, industrial machine, or any other working machine, such as a hydraulic excavator, wheel loader, crane, forklift truck, or dump truck.

The hydraulic cylinder device 11 includes a cylinder main body 11*e*, a piston 11*c* that slides along an inner region of the cylinder main body 11*e*, and a rod 11*d* that is coupled to the piston 11*c* and elongates outward from the cylinder main body 11*e*. The hydraulic cylinder device 11 is of a single-rod type, in which the rod 11*d* protrudes in one direction and the piston 11*c* serves to partition the inner region of the cylinder main body 11*e* into a bottom-side hydraulic chamber 11*a* and a rod-side hydraulic chamber 11*b*. The hydraulic cylinder device 11 is coupled at an end of the cylinder main body 11*e* to a movable member of the working machine, and extends/retracts itself, whereby then actuating the movable member, shown as a load W, to accomplish predetermined work.

The hydraulic closed circuit system according to the present embodiment includes the following: a first hydraulic pump 12 of a bidirectional delivery type, connected to the hydraulic cylinder device 11 so as to make a hydraulic closed circuit; a second hydraulic pump 13 of a bidirectional delivery and bidirectional variable displacement type, connected at one of paired delivery ports thereof to a bottom side of the hydraulic cylinder device 11 and at the other of the paired delivery ports to a tank 16; a prime mover 20 that drives the first and second hydraulic pumps 12, 13 and recovers motive power from the first and second hydraulic pumps 12, 13; and a pump capacity control unit 100 that detects a direction in which the hydraulic cylinder device 11 operates and a pressure applied on a lower-thrust side of the hydraulic cylinder device 11, and controls a capacity of the second hydraulic pump 13 such that a flow rate of a hydraulic fluid during the extension/retraction of the hydraulic cylinder device 11 becomes balanced between the first and second hydraulic pumps 12, 13 and the hydraulic cylinder device 11.

Where the hydraulic cylinder device 11 is large enough in capacity, at least one of the first and second hydraulic pumps 12, 13 may be a plurality of hydraulic pumps.

The hydraulic cylinder device 11 and the first and second hydraulic pumps 12, 13 are connected in a relationship, which is described in further detail below. One of paired delivery ports of the first hydraulic pump 12 is connected to a port Bp of the bottom-side hydraulic chamber 11*a* (i.e., a bottom-side port) of the hydraulic cylinder device 11 via a first line 14. The other of the paired delivery ports of the first hydraulic pump 12 is connected to a port Rp of the rod-side hydraulic chamber 11*b* (i.e., a rod-side port) of the hydraulic cylinder device 11 via a second line 15. The first hydraulic pump 12, the first line 14, the second line 15, and the hydraulic cylinder device 11 make the hydraulic closed circuit. One of paired delivery ports of the second hydraulic pump 13 is connected to the bottom-side port Bp of the hydraulic cylinder device 11 via the first line 14 and a third line 17 connected to the first line 14. The other of the paired delivery ports of the second hydraulic pump 13 is connected to the tank 16 via a fourth line 18.

The first and second hydraulic pumps 12, 13 are coupled to each other through a common drive shaft 21, and the drive shaft 21 is coupled to a drive shaft 22 of the prime mover 20. In power running of the hydraulic cylinder device 11, motive power is supplied from the prime mover 20 to the first and second hydraulic pumps 12, 13 by rotation of the prime mover 20. In regenerative operation of the hydraulic cylinder device 11, the first and second hydraulic pumps 12, 13 rotate the prime mover 20, and thereby the motive power is recovered. The power running of the hydraulic cylinder device 11 refers to the actuation of the hydraulic cylinder device 11 by the hydraulic fluid supplied from the first and second hydraulic pumps 12, 13 to the hydraulic cylinder device 11, and the regenerative operation of the hydraulic cylinder device 11 refers to the actuation of the hydraulic cylinder device 11 by the load W acting upon the hydraulic cylinder device 11.

In addition, by controlling a rotating speed of the prime mover 20, the flow rates of the hydraulic fluid discharged from the first and second hydraulic pumps 12, 13 (these flow rates are hereinafter referred to as the delivery flow rates) are controlled, and thus a moving velocity of the hydraulic cylinder device 11 is controlled. By switching a rotating direction of the prime mover 20, a delivery direction of the first and second hydraulic pumps 12, 13 is switched, and thus the moving direction of the hydraulic cylinder device 11 (i.e., whether the cylinder device 11 extends or retracts) is switched. The second hydraulic pump 13 has a regulator 23, which regulates the capacity of the second hydraulic pump 13.

The prime mover 20 according to the present embodiment is an electric motor, and the hydraulic closed circuit system includes a battery 25 for driving the electric motor 20, an inverter 26, an operating device 31, and a controller 35. The controller 35 has an electric motor control unit 41. The electric motor control unit 41 receives an operating signal from the operating device 31, then generates a control signal corresponding to an operating direction and operation amount of a control lever of the operating device 31, and outputs the control signal to the inverter 26. In accordance with the control signal, the inverter 26 controls a rotating direction and rotating speed of the electric motor 20 to match the operating direction and operation amount of the control lever of the operating device 31. The control of the rotating direction and rotating speed of the electric motor 20 controls the delivery directions and delivery flow rates of the first and second hydraulic pumps 12, 13, hence controlling a actuating direction and actuating speed of the hydraulic cylinder device 11. Additionally, when the hydraulic cylinder device 11 is in regenerative operation, the electric motor 20 functions as an electric power generator, and electric power that has been generated by the electric motor 20 is stored into the battery 25 as electrical energy.

The hydraulic closed circuit system also includes a pressure sensor (first pressure detecting device) 32 that detects a pressure applied to a bottom side of the hydraulic cylinder device 11, a pressure sensor (second pressure detecting device) 33 that detects a pressure applied to a rod side of the hydraulic cylinder device 11, and a position sensor (operation detecting device) 34 that detects the moving direction of the hydraulic cylinder device 11. The controller 35 further has a pump control unit 42.

The pump control unit 42 receives detection signals from the pressure sensors 32, 33 and the position sensor 34. Then the pump control unit 42 determines on the basis of the detected values whether the hydraulic cylinder device 11 is in power-running operation or in regenerative operation and whether the hydraulic cylinder device 11 is being extended or retracted. Referring to the determination results, the pump control unit 42 further calculates a correction value for the capacity of the second hydraulic pump 13, and outputs a control signal to the regulator 23 of the second hydraulic pump 13. The regulator 23 operates in accordance with the control signal, and regulates the capacity of the second hydraulic pump 13 by precisely regulating a tilt angle of the pump. This controls the capacity of the second hydraulic pump 13 so that a flow rate of the hydraulic fluid during the extension/retraction of the hydraulic cylinder device 11 becomes balanced between the first and second hydraulic pumps 12, 13 and the hydraulic cylinder device 11.

Details of the pump control by the pump control unit 42 are described below.

First, the background is described.

Referring to FIG. 1, if the piston 11*c* has pressure bearing area A1 (a bottom-side pressure bearing area) inside the bottom-side hydraulic chamber 11*a*, pressure bearing area A2 (a rod-side pressure bearing area) inside the rod-side hydraulic chamber 11*b*, and the rod 11*d* has cross-sectional area A3, a capacity of the first hydraulic pump 12 and that of the second hydraulic pump 13 are set so that the delivery flow rate Q1 of the first hydraulic pump 12 and the delivery flow rate Q2 of the second hydraulic pump 13 satisfy the following numerical expression:

$$Q2=(A3/A2)\times Q1 \quad (1)$$

If the pump capacities are thus set, this theoritically causes the flow rate during the extension/retraction of the hydraulic cylinder device 11 to become balanced between the first and second hydraulic pumps 12, 13 and the hydraulic cylinder device 11, hence resulting in no surplus or insufficiency of the inflow volume to or outflow volume from the hydraulic cylinder device 11. During actual operation, however, the hydraulic cylinder device 11 may fail to achieve an ideal flow rate balance during its extension/retraction, because of a hydraulic pump capacity setting error, a capacity error due to deterioration over time, a flow rate error due to leakage to an exterior, an influence of temperature, or the like. Failure to achieve the ideal flow rate balance during the extension/retraction of the hydraulic cylinder device 11 causes a surplus or insufficiency of the inflow volume to or outflow volume from the hydraulic cylinder device 11, and hence results in trouble such as cavitation due to the insufficiency of the flow rate, or an increase in pressure due to the build-up of pressure caused by a surplus of the flow rate.

Figure 2A:
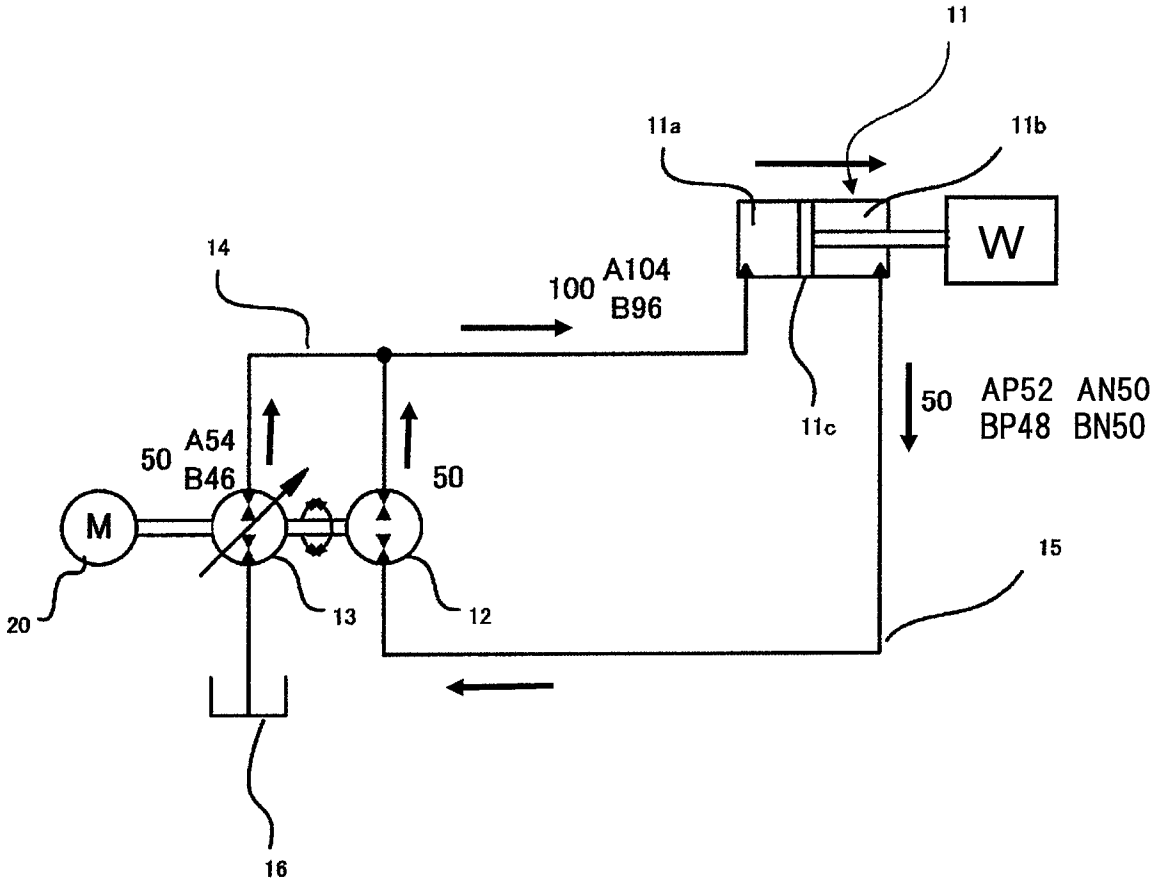
FIG. 2A shows a specific example of a flow rate balance obtained during extension of a hydraulic cylinder device.
Figure 2B:
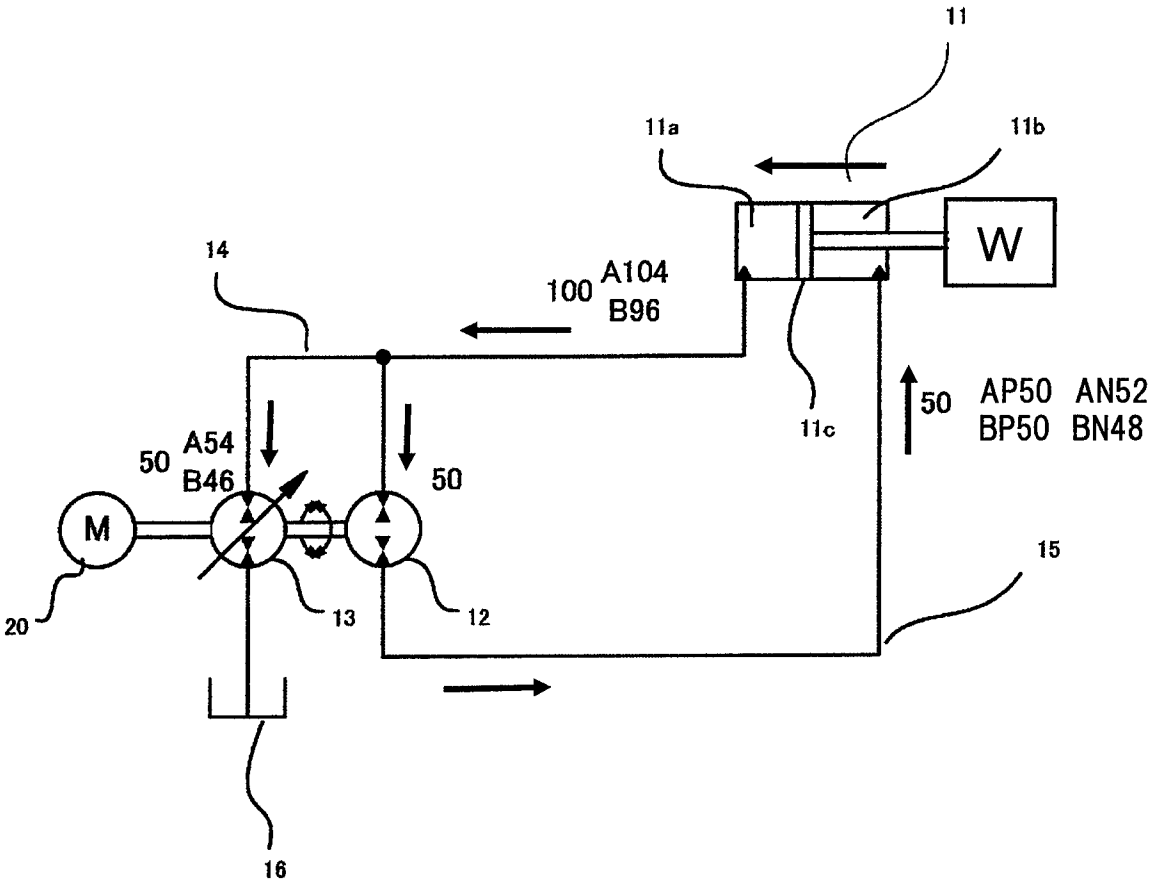
FIG. 2B shows a specific example of a flow rate balance obtained during retraction of the hydraulic cylinder device.

FIGS. 2A and 2B show specific examples of a flow rate balance obtained during the extension and retraction of the hydraulic cylinder device 11. The same elements as in FIG. 1 are each assigned the same reference number or symbol, and description of these elements is omitted herein.

FIG. 2A shows an example of a flow rate balance obtained when the hydraulic cylinder device 11 is extended, and FIG. 2B shows an example of a flow rate balance obtained when the hydraulic cylinder device 11 is retracted. Both figures assume that a ratio between the bottom-side pressure bearing area A1 and the rod-side pressure bearing area A2 is 2:1. In addition, the delivery flow rates of the first hydraulic pump 12 and the second hydraulic pump 13 are both shown as 50, the inflow volume to or the outflow volume from the bottom-side hydraulic chamber 11*a* of the hydraulic cylinder device 11 (i.e., the bottom-side flow rate) is shown as 100, and the outflow volume from or inflow volume to the rod-side hydraulic chamber 11*b* of the hydraulic cylinder device 11 (i.e., the rod-side flow rate) is shown as 50.

In both of the above examples that the hydraulic cylinder device 11 is extended in FIG. 2A and that the hydraulic cylinder device 11 is retracted in FIG. 2B, when the delivery flow rates of the first hydraulic pump 12 and the second hydraulic pump 13 are both 50, the flow rate is balanced during the extension/retraction of the hydraulic cylinder device 11. This results in no surplus or insufficiency of the inflow volume to or outflow volume from the hydraulic cylinder device 11.

Next, assume a situation in which the delivery flow rate of the second hydraulic pump 13 increases because of some kind of influence, and a situation in which the delivery flow rate of the second hydraulic pump 13 decreases. The flow rate in the former case is shown as A in FIGS. 2A, 2B, and the flow rate in the latter case is shown as B in the figures. In each of the examples that the hydraulic cylinder device 11 is extended as shown in FIG. 2A and that the hydraulic cylinder device 11 is retracted as shown in FIG. 2B, flow rate balances during the power-running operation and regenerative operation of the hydraulic cylinder device 11 are as follows, respectively.

1. In the Example of FIG. 2A that the Hydraulic Cylinder Device 11 is Extended 1-1. The Situation where the Delivery Flow Rate of the Second Hydraulic Pump 13 Increases Because of Some Kind of Influence (Flow Rate Shown as a in FIG. 2A)

[During Power Running] (Flow Rate Shown as AP in FIG. 2A)

The delivery flow rate of the second hydraulic pump 13 increases to 54 and as a result, the flow rates of the hydraulic fluid supplied from the first and second hydraulic pumps 12, 13 to the bottom side of the hydraulic cylinder device 11 increase to 104. Accordingly, when the hydraulic cylinder device 11 is in power running, the flow rate in the rod side of the hydraulic cylinder device 11 increases to 52. Since the first hydraulic pump 12 maintains the delivery flow rate of 50, however, the first hydraulic pump 12 maintains a suction flow rate of 50. This results in a surplus of the flow rate in the rod side of the hydraulic cylinder device 11, thus leading to an increase in pressure due to the build-up of pressure in the line 15 and in the rod-side hydraulic chamber 11*b* which becomes the lower-thrust side of the hydraulic cylinder device 11.

[During Regenerative Operation] (Flow Rate Shown as AN in FIG. 2A)

The delivery flow rate of the second hydraulic pump 13 increases to 54 and as a result, the flow rates of the hydraulic fluid supplied from the first and second hydraulic pumps 12, 13 to the bottom side of the hydraulic cylinder device 11 increase to 104. Since the first hydraulic pump 12 maintains the delivery flow rate of 50, however, the first hydraulic pump 12 maintains the suction flow rate of 50. Accordingly, when the hydraulic cylinder device 11 is in regenerative operation, since the hydraulic cylinder device 11 is driven by the load W so as to maintain the flow rate of 50 in the rod side, the flow rate in the bottom side of the hydraulic cylinder device 11 amounts to 100. This results in a surplus of the flow rate in the bottom side of the hydraulic cylinder device 11, thus leading to an increase in pressure due to the build-up of pressure in the line 14 and in the bottom-side hydraulic chamber 11*a* which becomes the lower-thrust side of the hydraulic cylinder device 11.

1-2. The Situation where the Delivery Flow Rate of the Second Hydraulic Pump 13 Decreases Because of Some Kind of Influence (Flow Rate Shown as B in FIG. 2A)

[During Power Running] (Flow Rate Shown as AP in FIG. 2A)

The delivery flow rate of the second hydraulic pump 13 decreases to 46 and as a result, the flow rates of the hydraulic fluid supplied from the first and second hydraulic pumps 12, 13 to the bottom side of the hydraulic cylinder device 11 decrease to 96. Accordingly, when the hydraulic cylinder device 11 is in power running, the flow rate in the rod side of the hydraulic cylinder device 11 decreases to 48. Since the first hydraulic pump 12 maintains the delivery flow rate of 50, however, the hydraulic cylinder device 11 maintains the suction flow rate of 50. This results in an insufficiency of the flow rate in the rod side of the hydraulic cylinder device 11, thus leading to cavitation occurring in the line 15 and in the rod-side hydraulic chamber 11*b* which becomes the lower-thrust side of the hydraulic cylinder device 11.

[During Regenerative Operation] (Flow Rate Shown as AN in FIG. 2A)

The delivery flow rate of the second hydraulic pump 13 decreases to 46 and as a result, the flow rates of the hydraulic fluid supplied from the first and second hydraulic pumps 12, 13 to the bottom side of the hydraulic cylinder device 11 decrease to 96. Since the first hydraulic pump 12 maintains the delivery flow rate of 50, however, the first hydraulic pump 12 maintains the suction flow rate of 50 as well. Accordingly, when the hydraulic cylinder device 11 is in regenerative operation, since the hydraulic cylinder device 11 is driven by the load W so as to maintain the flow rate of 50 in the rod side, the flow rate in the bottom side of the hydraulic cylinder device 11 amounts to 100. This results in an insufficiency of the flow rate in the bottom side of the hydraulic cylinder device 11, thus leading to cavitation occurring in the line 14 and in the bottom-side hydraulic chamber 11*a* which becomes the lower-thrust side of the hydraulic cylinder device 11.

2. In the Example of FIG. 2B that the Hydraulic Cylinder Device 11 is Retracted 2-1. The Situation where the Delivery Flow Rate of the Second Hydraulic Pump 13 Increases Because of Some Kind of Influence (Flow Rate Shown as A in FIG. 2B)

[During Power Running] (Flow Rate Shown as AP in FIG. 2B)

The delivery flow rate of the second hydraulic pump 13 increases to 54, so a suction flow rate of the second hydraulic pump 13 also increases to 54. In addition, since the first hydraulic pump 12 maintains the delivery flow rate of 50, the first hydraulic pump 12 maintains a suction flow rate of 50 as well. Consequently, a suction flow rate from the bottom side of the hydraulic cylinder device 11 by the first and second hydraulic pumps 12, 13 increases to 104. Furthermore, when the hydraulic cylinder device 11 is in power running, since the delivery flow rate of the first hydraulic pump 12 is maintained at 50, the flow rate in the bottom side of the hydraulic cylinder device 11 amounts to 100. This results in an insufficiency of the flow rate in the bottom side of the hydraulic cylinder device 11, thus leading to cavitation occurring in the line 14 and in the bottom-side hydraulic chamber 11*a* which becomes the lower-thrust side of the hydraulic cylinder device 11.

[During Regenerative Operation] (Flow Rate Shown as AN in FIG. 2B)

The delivery flow rate of the second hydraulic pump 13 increases to 54, so the suction flow rate of the second hydraulic pump 13 also increases to 54. In addition, since the first hydraulic pump 12 maintains the delivery flow rate of 50, the first hydraulic pump 12 maintains a suction flow rate of 50 as well. Consequently, a suction flow rate from the bottom side of the hydraulic cylinder device 11 by the first and second hydraulic pumps 12, 13 increases to 104. Accordingly, when the hydraulic cylinder device 11 is in regenerative operation, since the hydraulic cylinder device 11 is driven by the load W so as to maintain the flow rate of 104 in the bottom side, the flow rate in the rod side of the hydraulic cylinder device 11 increases to 52. This results in an insufficiency of the flow rate in the rod side of the hydraulic cylinder device 11, thus leading to cavitation occurring in the line 15 and in the rod-side hydraulic chamber 11*b* which becomes the lower-thrust side of the hydraulic cylinder device 11.

2-2. The Situation where the Delivery Flow Rate of the Second Hydraulic Pump 13 Decreases Because of Some Kind of Influence (Flow Rate Shown as B in FIG. 2B)

[During Power Running] (Flow Rate Shown as AP in FIG. 2B)

The delivery flow rate of the second hydraulic pump 13 decreases to 46, so the suction flow rate of the second hydraulic pump 13 also decreases to 46. In addition, since the first hydraulic pump 12 maintains the delivery flow rate of 50, the first hydraulic pump 12 maintains the suction flow rate of 50 as well. Consequently, the suction flow rate from the bottom side of the hydraulic cylinder device 11 by the first and second hydraulic pumps 12, 13 decreases to 96. Furthermore, when the hydraulic cylinder device 11 is in power running, since the delivery flow rate of the first hydraulic pump 12 is maintained at 50, the flow rate in the bottom side of the hydraulic cylinder device 11 amounts to 100. This results in a surplus of the flow rate in the bottom side of the hydraulic cylinder device 11, thus leading to an increase in pressure due to the build-up of pressure in the line 14 and in the bottom-side hydraulic chamber 11*a* which becomes the lower-thrust side of the hydraulic cylinder device 11.

[During Regenerative Operation] (Flow Rate Shown as AN in FIG. 2B)

The delivery flow rate of the second hydraulic pump 13 decreases to 46, so the suction flow rate of the second hydraulic pump 13 also decreases to 46. In addition, since the first hydraulic pump 12 maintains the delivery flow rate of 50, the first hydraulic pump 12 maintains the suction flow rate of 50 as well. Consequently, the suction flow rate from the bottom side of the hydraulic cylinder device 11 by the first and second hydraulic pumps 12, 13 decreases to 96. Accordingly, when the hydraulic cylinder device 11 is in regenerative operation, since the hydraulic cylinder device 11 is driven by the load W so as to maintain the flow rate of 96 in the bottom side, the flow rate in the rod side of the hydraulic cylinder device 11 decreases to 48. This results in a surplus of the flow rate in the rod side of the hydraulic cylinder device 11, thus leading to an increase in pressure due to the build-up of pressure in the line 15 and in the rod-side hydraulic chamber 11*b* which becomes the lower-thrust side of the hydraulic cylinder device 11.

In this way, if the delivery flow rates of the first hydraulic pump 12 and the second hydraulic pump 13 are both 50, this causes no surplus or insufficiency of the inflow volume to or outflow volume from the hydraulic cylinder device 11. During actual operation, however, the flow rate may not be balanced because of a pump capacity setting error, a capacity error due to deterioration over time, a flow rate error due to leakage to an exterior, the influence of temperature, or the like. If the flow rate is not balanced, this causes a surplus or insufficiency of the inflow volume to or outflow volume from the hydraulic cylinder device 11. As a result, cavitation due to the insufficiency of the flow rate, an increase in pressure due to the build-up of pressure caused by a surplus of the flow rate, or some other trouble will occur in the bottom side or rod side that becomes the lower-thrust side of the hydraulic cylinder device 11.

On the basis of the concept of solving these problems, the present invention is configured to automatically control a displacement volume (capacity) of the second hydraulic pump 13 and prevent the above trouble from occurring.

Figure 3A:
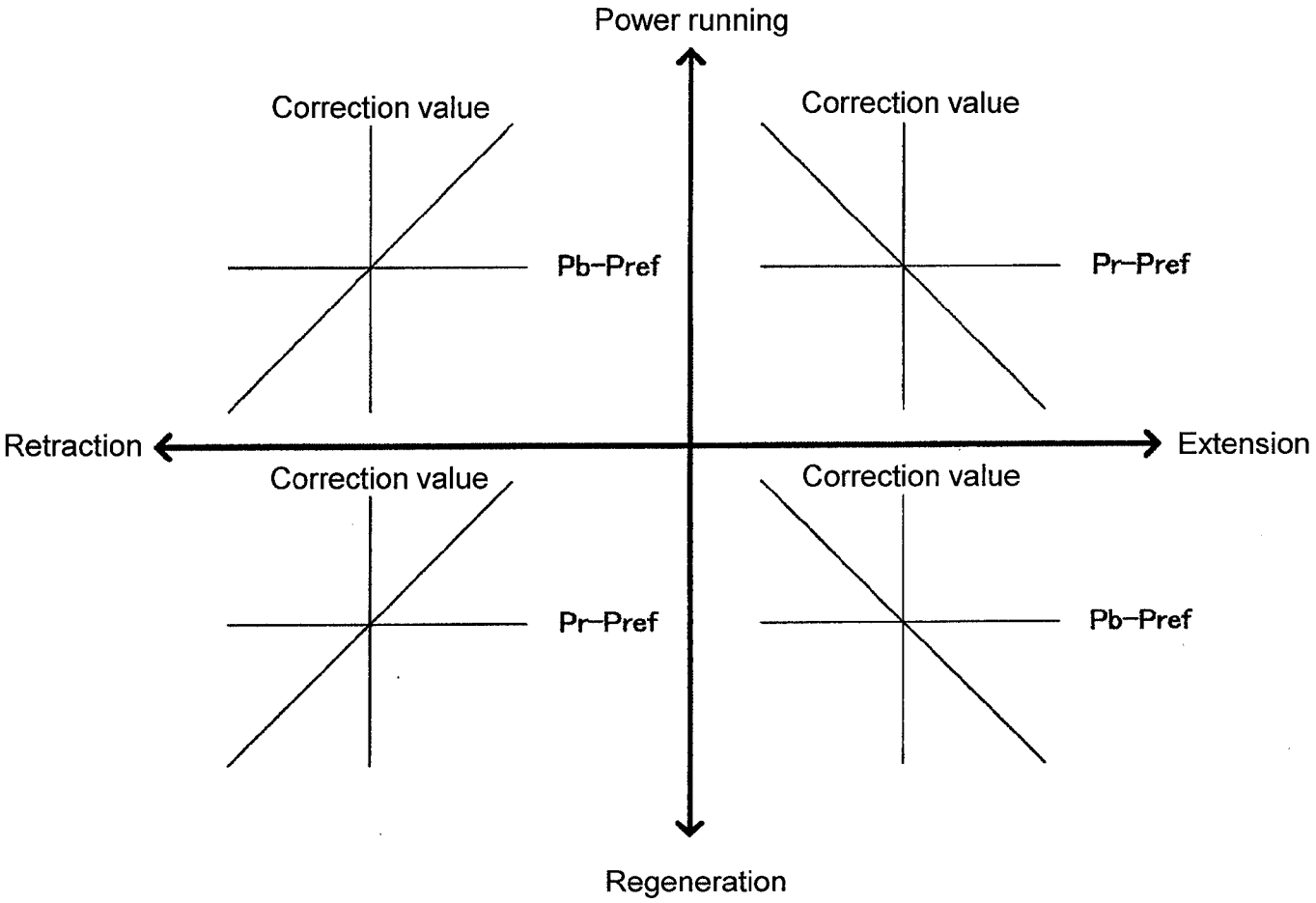
FIG. 3A shows an exemplary control method for a second hydraulic pump 13.

FIG. 3A shows an exemplary control method for the second hydraulic pump 13. In this control method for the second hydraulic pump 13, a correction value for a previously set capacity of the second hydraulic pump 13 is calculated using appropriate control parameters (correction calculating tables), depending on whether the hydraulic cylinder device 11 is being extended or retracted and on whether it is in the power-running state or in regenerative operation. More specifically, as detailed below, if a reference pressure value for determining whether a surplus or insufficiency of the flow rate is occurring in a lower-thrust side of the hydraulic cylinder device 11 is expressed as Pref, the bottom-side pressure as Pb, and the rod-side pressure as Pr, the present embodiment calculates the correction value for the previously set capacity of the second hydraulic pump 13 and corrects the capacity of the second hydraulic pump 13.

(a) When the hydraulic cylinder device 11 is being extended and in the power-running state The correction value is increased as the rod-side pressure Pr decreases relative to the reference pressure value Pref (i.e., as a value of Pr−Pref decreases), and the correction value is reduced for a negative slope as the rod-side pressure Pr increases (i.e., as the value of Pr−Pref increases).

(b) When the hydraulic cylinder device 11 is being extended and in regenerative operation The correction value is increased as the bottom-side pressure Pb decreases relative to the reference pressure value Pref (i.e., as a value of Pb−Pref decreases), and the correction value is reduced for a negative slope as the bottom-side pressure Pb increases (i.e., as the value of Pb−Pref increases).

(c) When the hydraulic cylinder device 11 is being retracted and in the power-running state The correction value is reduced as the bottom-side pressure Pb decreases relative to the reference pressure value Pref (i.e., as the value of Pb−Pref decreases), and the correction value is increased for a positive slope as the bottom-side pressure Pb increases (i.e., as the value of Pb−Pref increases).

(d) When the hydraulic cylinder device 11 is being retracted and in regenerative operation The correction value is reduced as the rod-side pressure Pr decreases relative to the reference pressure value Pref (i.e., as the value of Pr−Pref decreases), and the correction value is increased for a positive slope as the rod-side pressure Pr increases (i.e., as the value of Pr−Pref increases).

The reference pressure value Pref for determining whether a surplus or insufficiency of the flow rate is occurring in the lower-thrust side of the hydraulic cylinder device 11 is a pressure that does not cause troubles due to cavitation and an increase in pressure, and this pressure is preferably set to be slightly higher than the tank pressure. For example, if the tank pressure is 0.1 MPa, the reference pressure may take a value of nearly 0.2 MPa.

Figure 3B:
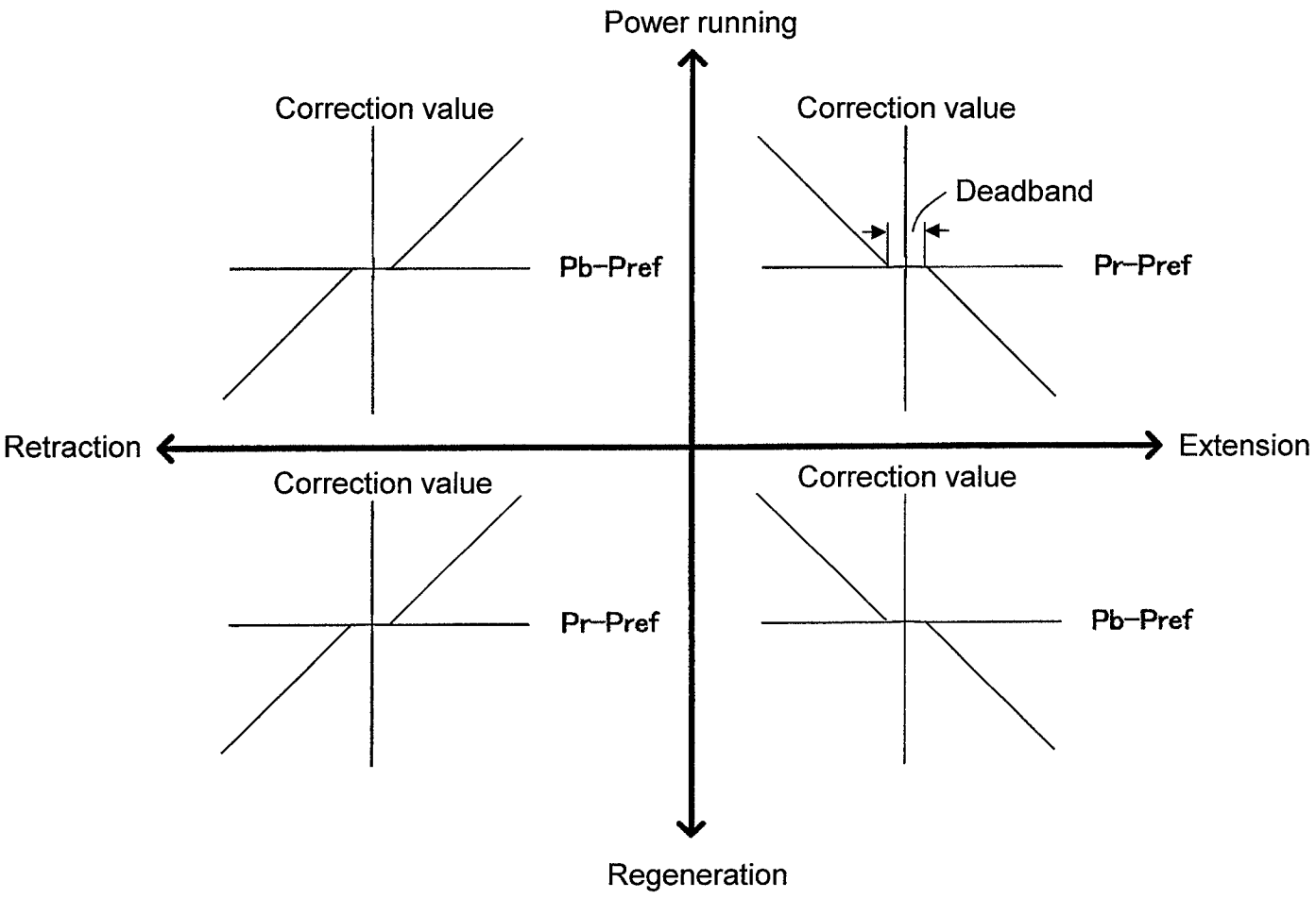
FIG. 3B shows another exemplary control method for the second hydraulic pump 13, this control method being applied to a case in which a deadband is provided in a predetermined pressure range including a reference pressure value.

FIG. 3B shows another exemplary control method for the second hydraulic pump 13. In this control method, correction calculating tables that will be selectively used, depending on whether the hydraulic cylinder device 11 is being extended or retracted and on whether it is in the power-running state or in regenerative operation, are each provided with a deadband in a predetermined pressure range including the reference pressure value Pref, and the capacity correction of the second hydraulic pump 13 is skipped in the predetermined pressure range. This allows the correction value of the pump capacity to be calculated only when pressure oversteps the deadband, and control to be executed only when necessary.

Figure 4:
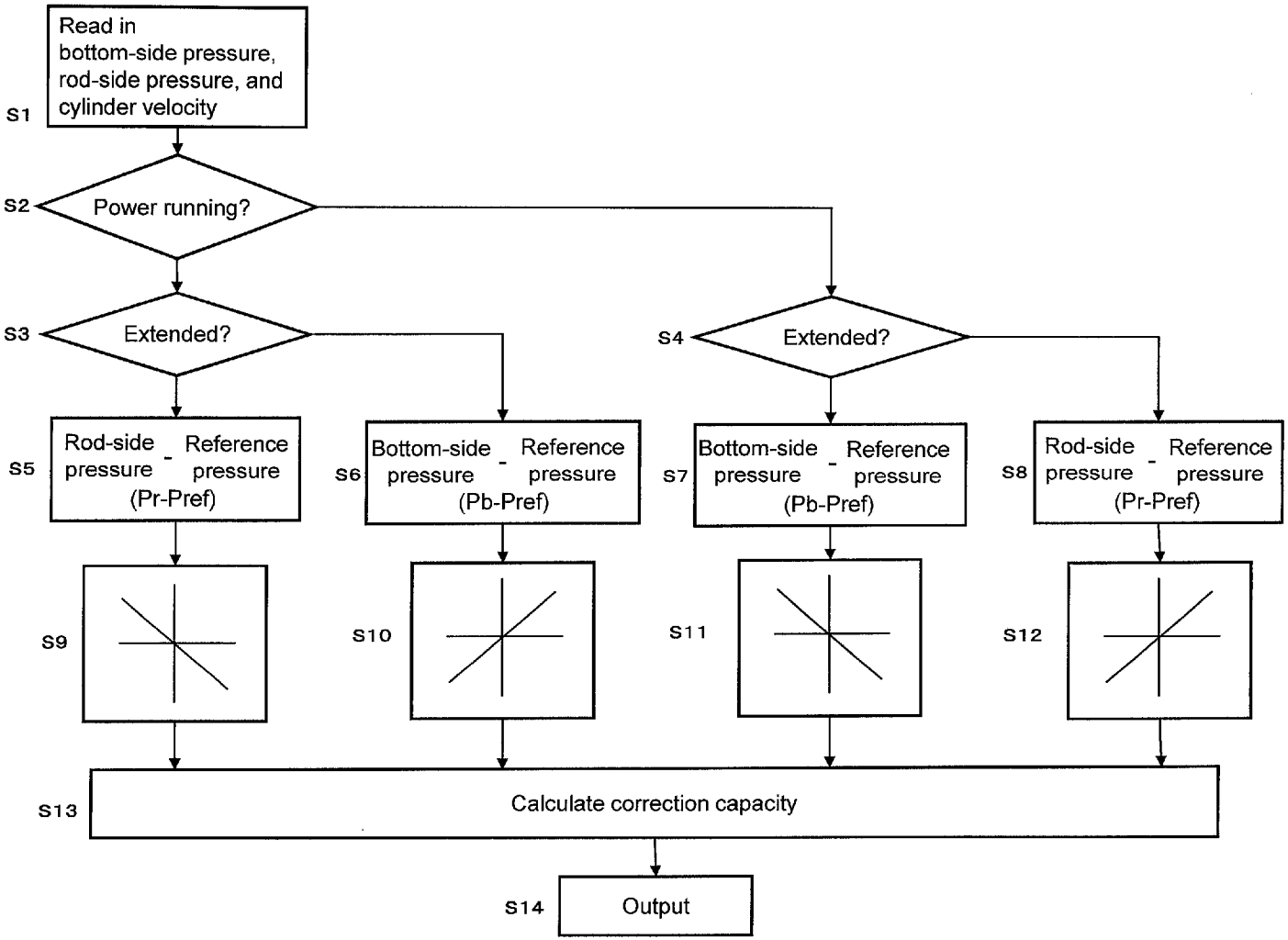
FIG. 4 shows a flow of process steps executed by a pump control unit to correct a capacity of the second hydraulic pump using the control methods shown in FIGS. 3A and 3B.

FIG. 4 shows a flow of process steps executed by the pump control unit 42 to correct the capacity of the second hydraulic pump 13 using the control methods shown in FIGS. 3A and 3B. The pump control unit 42 stores four kinds of correction calculating tables as shown in FIG. 3. These tables are: a correction calculating table used when the hydraulic cylinder device is being extended and is in power-running state, a correction calculating table used when the hydraulic cylinder device is being extended and is in regenerative operation, a correction calculating table used when the hydraulic cylinder device is being retracted and is in power-running state, and a correction calculating table used when the hydraulic cylinder device is being retracted and is in regenerative operation. The pump control unit 42 receives detection signals from the pressure sensors 32, 33 and the position sensor 34, then after calculating the bottom-side pressure Pb, rod-side pressure Pr, and cylinder velocity V of the hydraulic cylinder device 11, uses those tables to calculate the correction value for the capacity of the second hydraulic pump 13 and control the pump capacity. Details of this control process are described below.

Step S1

The bottom-side pressure Pb, rod-side pressure Pr, and cylinder velocity V of the hydraulic cylinder device 11 are calculated after the receipt of the detection signals from the pressure sensors 32, 33 and the position sensor 34.

Step S2

Whether the hydraulic cylinder device 11 is in power running operation or in regenerative operation is determined. This determination can be made by checking a sign of a value obtained from multiplying the cylinder thrust by the cylinder velocity. If the sign is plus (+), this denotes power running, and if the sign is minus (−), this denotes regeneration. To be more specific, if the extending direction of the cylinder is defined as a plus (+) direction, the following expression can be applied:

$$(A1 \cdot Pb - A2 \cdot Pr) \times V$$

+: power running

−: regeneration

If the hydraulic cylinder device 11 is in power running, the process advances to step S3, and if the device 11 is in regenerative operation, the process advances to step S4.

Steps S3, S4

On the basis of the cylinder velocity V, a determination is conducted as to whether the hydraulic cylinder device 11 is being extended or not. If the hydraulic cylinder device 11 is being extended, the process advances to step S5 or S7 first and then to step S9 or S11. If the hydraulic cylinder device 11 is not being extended, the process advances to steps S6 first and then S10 in that order.

Steps S5 and S9

A value of Pr−Pref, a deviation between the rod-side pressure Pr and the reference pressure value Pref, is calculated from both thereof. Next, the correction value for the capacity of the second hydraulic pump 13 is calculated from that deviation with reference to the correction calculating tables used when the hydraulic cylinder device is being extended and is in power-running state, shown in FIGS. 3A and 3B.

Steps S7 and S11

A value of Pb−Pref, a deviation between the bottom-side pressure Pb and the reference pressure value Pref, is calculated from both thereof. Next, the correction value for the capacity of the second hydraulic pump 13 is calculated from that deviation with reference to the correction calculating tables used when the hydraulic cylinder device is being extended and is in regenerative operation, shown in FIGS. 3A and 3B.

Steps S6 and S10

The value of Pb−Pref, the deviation between the bottom-side pressure Pb and the reference pressure value Pref, is calculated from both thereof. Next, the correction value for the capacity of the second hydraulic pump 13 is calculated from that deviation with reference to the correction calculating tables used when the hydraulic cylinder device is being retracted and is in power-running state, shown in FIGS. 3A and 3B.

Steps S8 and S12

The value of Pr−Pref, the deviation between the rod-side pressure Pr and the reference pressure value Pref, is calculated from both thereof. Next, the correction value for the capacity of the second hydraulic pump 13 is calculated from that deviation with reference to the correction calculating tables used when the hydraulic cylinder device is being retracted and is in regenerative operation, shown in FIGS. 3A and 3B.

Step S13

The correction value that was calculated in one of steps S9 to S12 is added to a target capacity Qref as a reference, and a correction capacity of the second hydraulic pump 13 is calculated as QCOR. The target capacity Qref is the flow rate Q2 shown in foregoing expression (1), and is the flow rate obtained from the capacity that has been set for the second hydraulic pump 13 in advance.

Step S14

The correction capacity QCOR is converted into a control quantity of the regulator 23 and then output as a control signal.

Next, operation of the system according to the present embodiment is described below.

In the present embodiment, the capacity of the second hydraulic pump 13 is set to be a capacity from which Q2 in expression (1) is obtained. Theoretically, if the pump capacity is thus set, the flow rate can be balanced because in neither the extending/retracting operation nor power-running/regenerative operation of the hydraulic cylinder device 11 will arise a surplus or insufficiency of the inflow volume to or outflow volume from the hydraulic cylinder device 11.

Next, consider a situation in which a change in the capacity of the second hydraulic pump 13 occurs for some reason and thus this results in the build-up of pressure due to a surplus of the flow rate.

The following describes how the hydraulic closed circuit system according to the present embodiment operates in such a case.

(In Case of the Build-Up of Pressure Due to a Surplus of the Flow Rate)

System operation is described below referring to FIG. 4.

(a) When the hydraulic cylinder device 11 is being extended and in power-running state Processes of steps S2, S3, S5 are executed in that order, and as the value of Pr−Pref increases, the correction value is reduced. This in turn reduces the capacity (tilt angle) of the second hydraulic pump 13, thus reducing the build-up of pressure due to the surplus of the flow rate in the rod side (rod-side hydraulic chamber 11*b* and line 15) of the hydraulic cylinder device 11.

(b) When the hydraulic cylinder device 11 is being retracted and in power-running state Processes of steps S2, S3, S6 are executed in that order, and as the value of Pb−Pref increases, the correction value is increased. This in turn increases the capacity (tilt angle) of the second hydraulic pump 13, thus reducing the build-up of pressure due to the surplus of the flow rate in the bottom side (bottom-side hydraulic chamber 11*a* and line 14) of the hydraulic cylinder device 11.

(c) When the hydraulic cylinder device 11 is being extended and in regenerative state Processes of steps S2, S4, S7 are executed in that order, and as the value of Pb−Pref increases, the correction value is reduced. This in turn reduces the capacity (tilt angle) of the second hydraulic pump 13, thus reducing the build-up of pressure due to the surplus of the flow rate in the bottom side (bottom-side hydraulic chamber 11*a* and line 14) of the hydraulic cylinder device 11.

(d) When the hydraulic cylinder device 11 is being retracted and in regenerative state Processes of steps S2, S4, S8 are executed in that order, and as the value of Pr−Pref increases, the correction value is increased. This in turn increases the capacity (tilt angle) of the second hydraulic pump 13, thus reducing the build-up of pressure due to the surplus of the flow rate in the rod side (rod-side hydraulic chamber 11*b* and line 15) of the hydraulic cylinder device 11.

In this way, an increase in pressure, caused by the build-up of pressure due to the surplus of the flow rate, is suppressed under all of the above device states.

Next, consider a situation in which a change in the capacity of the second hydraulic pump 13 occurs for some reason and this results in cavitation due to an insufficiency of the flow rate.

The following describes how the hydraulic closed circuit system according to the present embodiment operates in such a case.

(In Case of Cavitation Due to an Insufficiency of the Flow Rate)

System operation is described below referring to FIG. 4.

(a) When the hydraulic cylinder device 11 is being extended and in power-running state Processes of steps S2, S3, S5 are executed in that order, and as the value of Pr−Pref decreases, the correction value is increased. This in turn increases the capacity (tilt angle) of the second hydraulic pump 13, thus reducing cavitation due to the insufficiency of the flow rate in the rod side (rod-side hydraulic chamber 11*b* and line 15) of the hydraulic cylinder device 11.

(b) When the hydraulic cylinder device 11 is being retracted and in power-running state Processes of steps S2, S3, S6 are executed in that order, and as the value of Pb−Pref decreases, the correction value is reduced. This in turn reduces the capacity (tilt angle) of the second hydraulic pump 13, thus reducing cavitation due to the insufficiency of the flow rate in the bottom side (bottom-side hydraulic chamber 11*a* and line 14) of the hydraulic cylinder device 11.

(c) When the hydraulic cylinder device 11 is being extended and in regenerative state Processes of steps S2, S4, S7 are executed in that order, and as the value of Pb−Pref decreases, the correction value is increased. This in turn increases the capacity (tilt angle) of the second hydraulic pump 13, thus reducing cavitation due to the insufficiency of the flow rate in the bottom side (bottom-side hydraulic chamber 11*a* and line 14) of the hydraulic cylinder device 11.

(d) When the hydraulic cylinder device 11 is being retracted and in regenerative state Processes of steps S2, S4, S8 are executed in that order, and as the value of Pr−Pref decreases, the correction value is reduced. This in turn reduces the capacity (tilt angle) of the second hydraulic pump 13, thus reducing cavitation due to the insufficiency of the flow rate in the rod side (rod-side hydraulic chamber 11*b* and line 15) of the hydraulic cylinder device 11.

In this way, cavitation due to the insufficiency of the flow rate is suppressed under all of the above device states.

Under the situation that for some reason the capacity of the first hydraulic pump 12 changes from the capacity that provides Q1 shown in expression (1), operation is likewise controlled, which allows effective suppression of cavitation due to an insufficiency of the flow rate and the increase in pressure caused by the build-up of pressure due to a surplus of the flow rate.

As described above, in the hydraulic closed circuit system according to the present embodiment that uses the plurality of hydraulic pumps, even if such a pump capacity error as in at least one of the first hydraulic pump 12 and the second hydraulic pump 13 causes an imbalance of a flow rate during the extension/retraction of the hydraulic cylinder device 11, the system regulates the flow rate automatically, maintains a well-balanced flow rate at all times, and thus can effectively suppress cavitation due to an insufficiency of the flow rate and the increase in pressure caused by the build-up of pressure due to a surplus of the flow rate.

In addition, the hydraulic closed circuit system according to the present embodiment eliminates the need for the low pressure selecting valve (flushing valve) generally provided for hydraulic fluid circulation in a conventional hydraulic closed circuit system, so that in this context the hydraulic closed circuit system according to the present embodiment becomes simplified and more compact. A charge circuit for preventing cavitation is not needed, either, in which context the system becomes further simplified and even more compact. This makes the system advantageous in costs as well as in performance.

Second Embodiment

Figure 5:
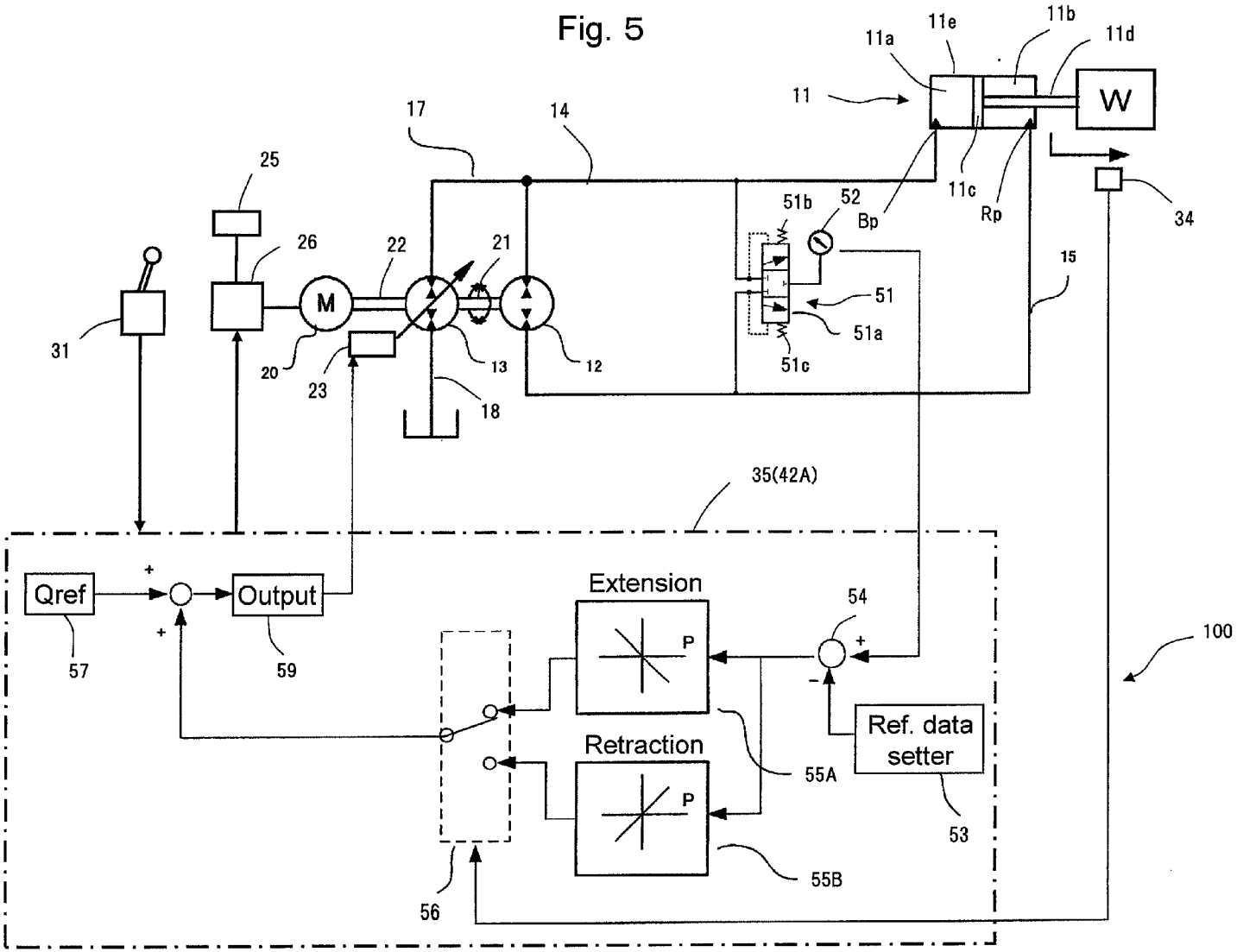
FIG. 5 shows a configuration of a hydraulic closed circuit system according to a second embodiment of the present invention.

FIG. 5 shows a configuration of a hydraulic closed circuit system according to a second embodiment of the present invention.

Referring to FIG. 5, instead of having the pressure sensors 32, 33 used in the hydraulic closed circuit system according to the first embodiment shown in FIG. 1, the hydraulic closed circuit system according to the second embodiment includes a lower-thrust-side pressure selecting valve 51 and a pressure sensor (pressure detection device) 52. The lower-thrust-side pressure selecting valve 51 selects a pressure in a lower-thrust side of the hydraulic cylinder device 11 between hydraulic pressures present inside a bottom-side hydraulic chamber 11*a* and rod-side hydraulic chamber 11*b* of a hydraulic cylinder device 11. The pressure sensor (pressure detection device) 52 detects the pressure that the lower-thrust-side pressure selecting valve 51 has selected. In addition, a controller 35 includes a pump control unit 42A instead of the pump control unit 42 used in the first embodiment. In accordance with the values detected by a position sensor (operation detecting device) 34 and the pressure sensor (pressure detection device) 52, the pump control unit 42A calculates a correction value for a capacity of a second hydraulic pump 13 and controls the capacity of the second hydraulic pump 13.

The lower-thrust-side pressure selecting valve 51 is constructed so that the pressures from the bottom-side hydraulic chamber 11*a* and rod-side hydraulic chamber 11*b* of the hydraulic cylinder device 11 are guided to both ends of a three-position spool 51*a*, and so that both ends of the spool 51*a* are held in a neutral position by springs 51*b* and 51*c*. If a ratio between pressure bearing area A1 of the bottom-side hydraulic chamber 11*a* and pressure bearing area A2 of the rod-side hydraulic chambers 11*b* is 2:1 as mentioned above, then the springs 51*b*, 51*c* have a spring load ratio of 1:2. This configuration is intended to allow the lower-thrust-side pressure selecting valve 51 to select the pressure in the chamber having lower thrust (lower cylinder thrust) of a piston 11*c*, between the pressures in the bottom-side hydraulic chamber 11*a* and rod-side hydraulic chamber 11*b* of the hydraulic cylinder device 11. If the hydraulic actuator used is a hydraulic motor or the like having the same pressure-bearing area at both ports thereof, the spring load ratio of the springs 51*b*, 51*c* is 1:1 and a low pressure selecting valve, which simply selects a lower-pressure side of the hydraulic actuator, can be used. If the hydraulic actuator is the hydraulic cylinder device 11 or the like having different pressure-bearing areas at both ports, the pressure of the lower-thrust side can be selected and detected by previously setting the spring characteristics according to the particular pressure bearing area ratio, as above.

The pump control unit 42A includes the following: a reference data setter 53 that sets a reference pressure value Pref; a difference unit 54 that calculates a difference between the reference pressure value Pref and the pressure detected by the pressure sensor 52; a first calculating device 55A that calculates, from the differential value obtained from the calculation by the difference unit 54, a correction value for the capacity of the second hydraulic pump 13 operative when the hydraulic cylinder device 11 is being extended; a second calculating device 55B that calculates, from the differential value obtained from the calculation by the difference unit 54, a correction value for the capacity of the second hydraulic pump 13 operative when the hydraulic cylinder device 11 is being retracted; a selector 56 adapted so that when a moving direction of the hydraulic cylinder device 11 detected by the position sensor 34 indicates the extending operation on the basis of a moving velocity V of the cylinder device 11, the selector 56 selects the first calculating device 55A, and when the moving direction of the hydraulic cylinder device 11 indicates the retracting operation, the selector 56 selects the second calculating device 55B; a target capacity setter 57 that sets a target capacity Qref as a reference; a corrector (adder) 58 that adds the correction value of the pump capacity, the correction value being previously calculated by the first calculating device 55A or second calculating device 55B that the selector 56 has selected, to the target capacity Qref as the reference, and thus calculates the correction capacity QCOR of the second hydraulic pump 13; and an output device 59 that converts the correction capacity QCOR into a control quantity of a regulator 23 and then outputs the control quantity as a control signal.

The first calculating device 55A uses one correction calculating table corresponding to cylinder extension to conduct substantially the same calculation as done in step S9 and S11 of FIG. 4 in the first embodiment. The first calculating device 55A views the correction calculating table corresponding to cylinder extension and after referring to the differential value obtained from the calculation by the difference unit 54, calculates the correction value for the capacity of the second hydraulic pump 13. The second calculating device 55B uses one correction calculating table corresponding to cylinder retraction to conduct substantially the same calculation as done in step S10 and S12 of FIG. 4 in the first embodiment. The second calculating device 55B views the correction calculating table corresponding to cylinder retraction and after referring to the differential value obtained from the calculation by the difference unit 54, calculates the correction value for the capacity of the second hydraulic pump 13.

The present embodiment having the above configuration provides substantially the same advantageous effects as those of the first embodiment.

In the present embodiment, both of thrust calculation and determination of the lower-thrust side by the controller 35 can also be omitted, so that arithmetic processing by the controller 35 can be simplified. In addition, the number of pressure sensors can be reduced, which provides a greater advantage in terms of costs.

Third Embodiment

Figure 6:
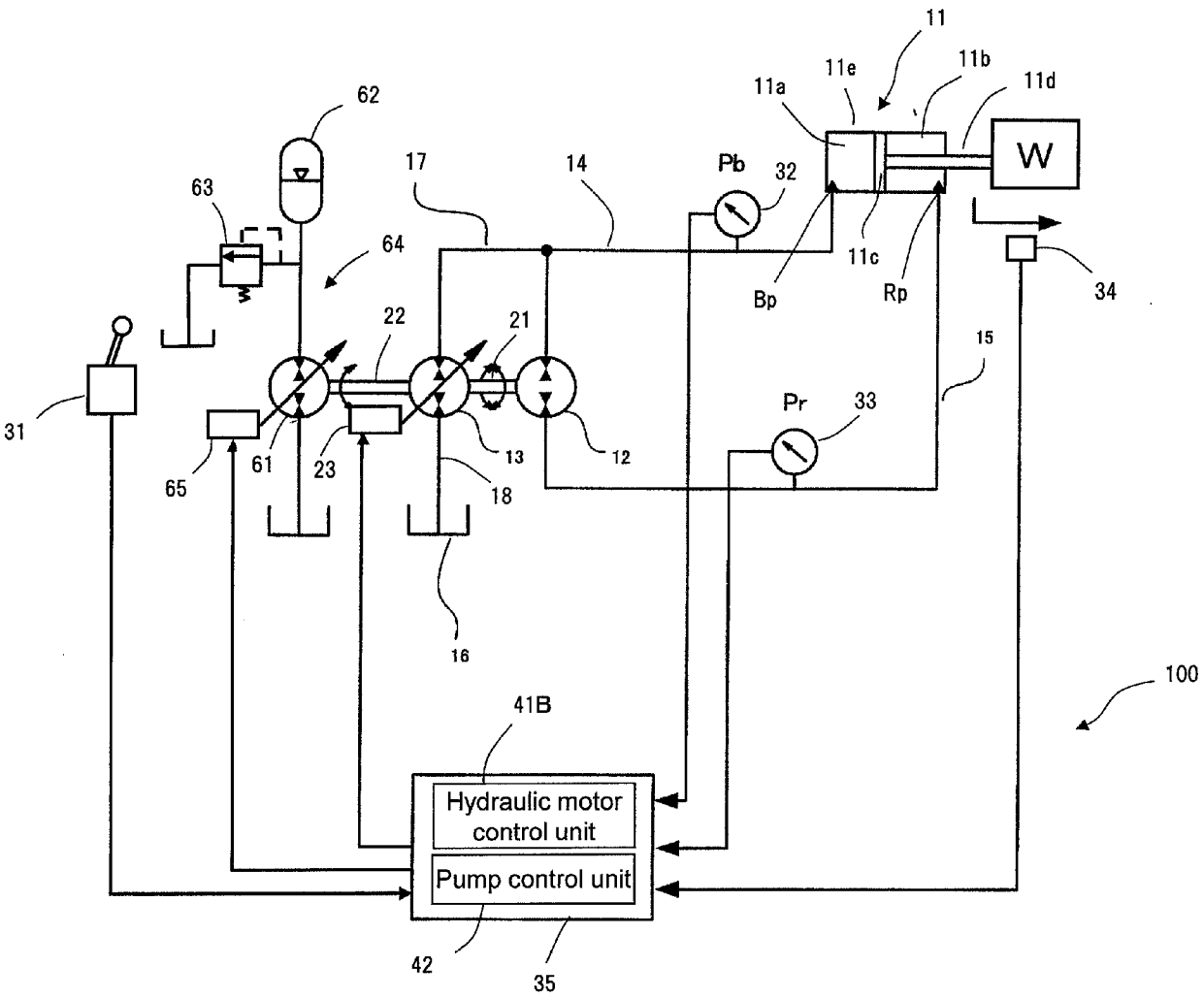
FIG. 6 shows a configuration of a hydraulic closed circuit system according to a third embodiment of the present invention.

FIG. 6 shows a configuration of a hydraulic closed circuit system according to a third embodiment of the present invention.

In the present invention, a prime mover that drives the first and second hydraulic pumps can be any kind of element adapted for input and output of motive power. For example, the prime mover can be a hydraulic motor as well as a electric motor. The third embodiment uses a hydraulic motor as the prime mover.

Referring to FIG. 6, the hydraulic closed circuit system according to the present embodiment includes the hydraulic motor 61 of a bidirectional variable displacement type instead of the electric motor 20 as the prime mover shown in FIG. 1. The hydraulic motor 61 is connected to a low-pressure generator system 64 that includes an accumulator 62 and a safety relief valve 63. The low-pressure generator system 64 is constructed so that as heretofore known, when the hydraulic motor 61 is in power running to drive the first and second hydraulic pumps 12, 13, the motor 61 is actuated by hydraulic energy stored within the accumulator 62, and when the hydraulic motor 61 is actuated by the first and second hydraulic pumps 12, 13 to regenerate, rotational energy of the motor 61 is stored into the accumulator 62 as hydraulic energy. A hydraulic pump (not shown) that is driven by an engine or the like may be connected to the low-pressure generator system 64 to provide against a shortage of the hydraulic energy stored within the accumulator 62.

In addition, the hydraulic motor 61 has a regulator 65 and the controller 35 has a hydraulic motor control unit 41B instead of the electric motor control unit 41 shown in FIG. 1. The hydraulic motor control unit 41B receives an operating signal from an operating device 31, then generates a control signal corresponding to an operating direction and operation amount of a control lever of the operating device 31, and outputs the control signal to the regulator 65. In accordance with the control signal, the regulator 65 controls a tilting direction and tilting angle of the hydraulic motor 61 so that a rotating direction and rotating speed of the hydraulic motor 61 match the operating direction and operation amount of the control lever of the operating device 31. The control of the rotating direction and rotating speed of the hydraulic motor 61 controls delivery directions and delivery flow rates of the first and second hydraulic pumps 12, 13, hence controlling a actuating direction and actuating speed of the hydraulic cylinder device 11.

The present embodiment having the above configuration provides substantially the same advantageous effects as those of the first embodiment.

In the present embodiment, when the hydraulic cylinder device 11 is in regenerative operation, the first and second hydraulic pumps 12, 13 rotate the hydraulic motor 61, whereby the regenerated motive power can be recovered in the accumulator 62 as hydraulic energy.

Fourth Embodiment

Figure 7:
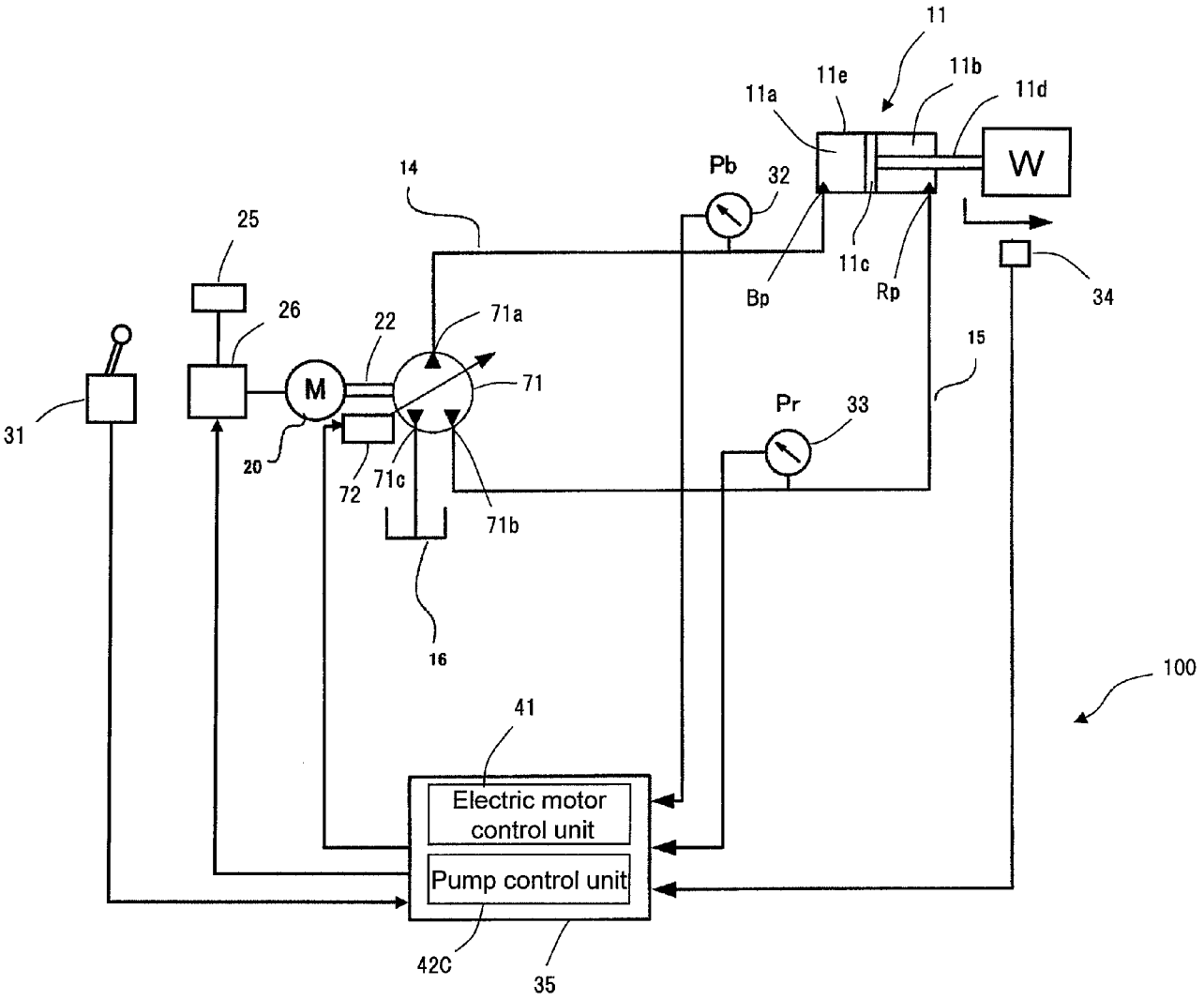
FIG. 7 shows a configuration of a hydraulic closed circuit system according to a fourth embodiment of the present invention.

FIG. 7 shows a configuration of a hydraulic closed circuit system according to a fourth embodiment of the present invention.

The fourth embodiment of the present invention has a system configuration with a pump of a single-pump double-port flow distribution type serving as both a first and a second hydraulic pump.

Referring to FIG. 7, instead of having separately the first and second hydraulic pumps 12, 13 coupled to the common drive shaft 21 shown in FIG. 1, the hydraulic closed circuit system according to the present embodiment includes a split-flow pump 71 known as a pump of the single-pump double-port flow distribution type. The split-flow pump 71 includes one delivery/suction port 71*a* and two suction/delivery ports 71*b* and 71*c*. The delivery/suction port 71*a* is connected to a bottom side of a hydraulic cylinder device 11 via a line 14. In addition, one port 71*b* of the two suction/delivery ports 71*b*, 71*c* is connected to a rod side of the hydraulic cylinder device 11 via a line 15, and the other port 71*c* is connected to a tank 16. The delivery/suction port 71*a* and suction/delivery port 71*b* of the split-flow pump 71 function together as the first hydraulic pump, and the delivery/suction port 71*a* and the suction/delivery port 71*c* function together as the second hydraulic pump.

The split-flow pump 71 also includes a regulator 72 to change a flow rate ratio between the two suction/delivery ports 71*b* and 71*c*. A controller 35 includes a pump control unit 42C instead of the pump control unit 42. In accordance with the values detected by pressure sensors 32, 33 and a position sensor 34 (operation detecting device), the pump control unit 42C calculates a correction value for the flow rate ratio between the suction/delivery ports 71*b*, 71*c* of the split-flow pump 71, and then outputs a relevant control signal to the regulator 72. In accordance with the control signal, the regulator 72 controls the flow rate ratio between the two suction/delivery ports 71*b*, 71*c*.

The present embodiment having the above configuration provides substantially the same advantageous effects as those of the first embodiment.

Additionally, in the present embodiment, one pump has two pump functions, which makes the system simpler and more compact, hence providing a greater advantage in terms of costs.

While a pump of the single-pump double-port flow distribution type is used as the first and second hydraulic pumps in the present embodiment, a double-pump integral type of pump unit with two delivery/suction ports and two suction/delivery ports may instead be used, whereby substantially the same advantageous effects can also be obtained.

DESCRIPTION OF REFERENCE NUMBERS

11: Hydraulic cylinder device
12: First hydraulic pump
13: Second hydraulic pump
14, 15, 17, 18: Lines
16: Tank
20: Electric motor (Prime mover)
21: Drive shaft
22: Drive shaft
23: Regulator
25: Battery
26: Inverter
31: Operating device
32, 33: Pressure sensors (Pressure detection devices)
34: Position sensor (Operation detecting device)
35: Controller
41: Electric motor control unit
41B: Hydraulic motor control unit
42: Pump control unit
42A: Pump control unit
42C: Pump control unit
51: Lower-thrust-side pressure selecting valve
52: Pressure sensor
53: Reference data setter
54: Difference unit
55A: First calculating device
55B: Second calculating device
56: Selector
57: Target capacity setter
58: Corrector (adder)
59: Output device
61: Hydraulic motor (Prime mover)
62: Accumulator
63: Safety relief valve
64: Constant-pressure generator system
65: Regulator
71: Split-flow pump
71*a*: One delivery/suction port
71*b*, 71*c*: Two delivery/suction ports
72: Regulator

The invention claimed is:

1. A hydraulic closed circuit system, comprising:
a hydraulic cylinder device;
a first hydraulic pump of a bidirectional delivery type connected to the hydraulic cylinder device in such a manner that a hydraulic closed circuit is made;
a second hydraulic pump of a bidirectional delivery and bidirectional variable displacement type, connected at one of paired delivery ports thereof to a bottom side of the hydraulic cylinder device and at the other of the paired delivery ports to a tank;
a prime mover that drives the first and second hydraulic pumps and recovers motive power from the first and second hydraulic pumps; and
a pump capacity control unit configured to:
detect a direction in which the hydraulic cylinder device operates,
detect a pressure applied on a lower-thrust side of the hydraulic cylinder device, and
control a capacity of the second hydraulic pump such that a flow rate of a hydraulic fluid during extension/retraction of the hydraulic cylinder device becomes balanced between the first and second hydraulic pumps and the hydraulic cylinder device,
wherein the pump capacity control unit, during an extending operation of the hydraulic cylinder device, is further configured to:
when the pressure on the lower-thrust side of the hydraulic cylinder device is lower than a reference pressure value, increase the capacity of the second hydraulic pump, and
when the pressure on the lower-thrust side of the hydraulic cylinder device is higher than the reference pressure value, decrease the capacity of the second hydraulic pump, and
wherein the pump capacity control unit, during a retracting operation of the hydraulic cylinder device, is further configured to:
when the pressure on the lower-thrust side of the hydraulic cylinder device is higher than the reference pressure value, increase the capacity of the second hydraulic pump, and
when the pressure on the lower-thrust side of the hydraulic cylinder device is lower than the reference pressure value, decrease the capacity of the second hydraulic pump.

2. The hydraulic closed circuit system according to claim 1, wherein the pump capacity control unit includes:

an operation detecting device that detects the direction in which the hydraulic cylinder device operates;

a first and a second pressure detecting device configured to detect respectively a pressure applied to the bottom side of the hydraulic cylinder device, and a pressure applied to a rod side of the hydraulic cylinder device; and a pump capacity correcting device configured to determine, on the basis of values detected by the operation detecting device and the first and second pressure detecting devices, whether the hydraulic cylinder device is in a power-running operation or in a regenerative operation and whether the hydraulic cylinder device is being extended or retracted, calculate a correction value for the capacity of the second hydraulic pump on the basis of results of the determination, and thereby control the capacity of the second hydraulic pump, and wherein the reference pressure value is expressed as Pref, the bottom-side pressure of the hydraulic cylinder device is expressed as Pb, and the rod-side pressure of the hydraulic cylinder device is expressed as Pr, and the pump capacity correcting device is further configured to:

(a) when the hydraulic cylinder device is being extended and is in the power-running operation, increase the correction value as the rod-side pressure Pr decreases relative to the reference pressure value Pref, and reduces the correction value as the rod-side pressure Pr increases;

(b) when the hydraulic cylinder device is being extended and is in the regenerative operation, increase the correction value as the bottom-side pressure Pb decreases relative to the reference pressure value Pref, and reduce the correction value as the bottom-side pressure Pb increases;

(c) when the hydraulic cylinder device is being retracted and is in the power-running operation, reduce the correction value as the bottom-side pressure Pb decreases relative to the reference pressure value Pref, and increase the correction value as the bottom-side pressure Pb increases; and (d) when the hydraulic cylinder device is being retracted and is in the regenerative operation, reduce the correction value as the rod-side pressure Pr decreases relative to the reference pressure value Pref, and increase the correction value as the rod-side pressure Pr increases.

3. The hydraulic closed circuit system according to claim 2, wherein the pump capacity correcting device provides a deadband in which the pump capacity correcting device does not correct the capacity of the second hydraulic pump in a predetermined pressure range including the reference pressure value.

4. The hydraulic closed circuit system according to claim 3, wherein the prime mover is an electric motor or a hydraulic motor.

5. The hydraulic closed circuit system according to claim 3, wherein the first and second hydraulic pumps are a pump of a single-pump double-port flow distribution type, and wherein the pump capacity control unit controls the capacity of the second hydraulic pump by changing a flow rate ratio of the hydraulic fluid in two ports of the pump of the single-pump double-port flow distribution type.

6. The hydraulic closed circuit system according to claim 2, wherein the prime mover is an electric motor or a hydraulic motor.

7. The hydraulic closed circuit system according to claim 2, wherein the first and second hydraulic pumps are a pump of a single-pump double-port flow distribution type, and wherein the pump capacity control unit controls the capacity of the second hydraulic pump by changing a flow rate ratio of the hydraulic fluid in two ports of the pump of the single-pump double-port flow distribution type.

8. The hydraulic closed circuit system according to claim 1, wherein the pump capacity control unit includes:

an operation detecting device that detects the direction in which the hydraulic cylinder device operates;

a lower-thrust-side pressure selecting valve that selects, from pressures inside a bottom-side hydraulic chamber and a rod-side hydraulic chamber of the hydraulic cylinder device, the pressure inside the hydraulic chamber of the lower-thrust side of the hydraulic cylinder device;

a pressure detection device that detects the pressure that the lower-thrust-side pressure selecting valve has selected; and a pump capacity correcting device configured to calculate a correction value for the capacity of the second hydraulic pump on the basis of values detected by the operation detecting device and the pressure detection device, and thereby control the capacity of the second hydraulic pump, wherein the pump capacity correcting device includes:

a reference data setter that sets the reference pressure value;

a first calculating device that calculates, from a differential value between the reference pressure value and the pressure value detected by the pressure detection device, a correction value for the capacity of the second hydraulic pump operative when the hydraulic cylinder device is being extended;

a second calculating device that calculates, from a differential value between the reference pressure value and the pressure value detected by the pressure detection device, a correction value for the capacity of the second hydraulic pump operative when the hydraulic cylinder device is being retracted; and a selector that selects one of the first and second calculating devices, depending upon the operating direction of the hydraulic cylinder device that the operation detecting device has detected.

9. The hydraulic closed circuit system according to claim 8, wherein the pump capacity correcting device provides a deadband in which the pump capacity correcting device does not correct the capacity of the second hydraulic pump in a predetermined pressure range including the reference pressure value.

10. The hydraulic closed circuit system according to claim 8, wherein the prime mover is an electric motor or a hydraulic motor.

11. The hydraulic closed circuit system according to claim 8, wherein the first and second hydraulic pumps are a pump of a single-pump double-port flow distribution type, and wherein the pump capacity control unit controls the capacity of the second hydraulic pump by changing a flow rate ratio of the hydraulic fluid in two ports of the pump of the single-pump double-port flow distribution type.

12. The hydraulic closed circuit system according to claim 1, wherein the prime mover is an electric motor or a hydraulic motor.

13. The hydraulic closed circuit system according to claim 1, wherein the first and second hydraulic pumps are a pump of a single-pump double-port flow distribution type, and wherein the pump capacity control unit controls the capacity of the second hydraulic pump by changing a flow rate ratio of the hydraulic fluid in two ports of the pump of the single-pump double-port flow distribution type.

* * * * *